US009352384B2

(12) United States Patent
Howell et al.

(10) Patent No.: US 9,352,384 B2
(45) Date of Patent: May 31, 2016

(54) CYLINDER HEAD CASTING APPARATUS AND METHODS

(71) Applicant: Honda Motor Co., Ltd., Tokyo (JP)

(72) Inventors: Drew Howell, Anna, OH (US); Matthew Pettus, Botkins, OH (US)

(73) Assignee: Honda Motor Co., Ltd., Tokyo (JP)

( * ) Notice: Subject to any disclaimer, the term of this patent is extended or adjusted under 35 U.S.C. 154(b) by 36 days.

(21) Appl. No.: 14/287,410

(22) Filed: May 27, 2014

(65) Prior Publication Data

US 2015/0343520 A1 Dec. 3, 2015

(51) Int. Cl.

| | |
|---|---|
| ***B22C 9/08*** | (2006.01) |
| ***B22D 27/04*** | (2006.01) |
| ***B22D 25/02*** | (2006.01) |

(52) U.S. Cl.

CPC . *B22C 9/08* (2013.01); *B22D 25/02* (2013.01); *B22D 27/045* (2013.01)

(58) Field of Classification Search

CPC ..... B22D 17/00; B22D 17/20; B22D 17/22; B22D 17/2218; B22D 27/00; B22D 27/04; B22C 9/00; B22C 9/06; B22C 9/065

See application file for complete search history.

(56) References Cited

U.S. PATENT DOCUMENTS

| | | | | |
|---|---|---|---|---|
| 3,752,221 | A | 8/1973 | Copley et al. | |
| 4,616,690 | A * | 10/1986 | Demange | B22D 5/00 164/128 |
| 4,671,337 | A | 6/1987 | Kawai et al. | |
| 4,875,518 | A | 10/1989 | Imura et al. | |
| 5,381,851 | A | 1/1995 | Bilz et al. | |
| 6,311,760 | B1 | 11/2001 | Fernihough et al. | |
| 6,422,294 | B1 | 7/2002 | Murata et al. | |
| 8,047,262 | B2 | 11/2011 | Kweon | |
| 8,176,968 | B1 * | 5/2012 | Eshleman | B22C 9/067 164/113 |

* cited by examiner

*Primary Examiner* — Kevin P Kerns
*Assistant Examiner* — Steven Ha
(74) *Attorney, Agent, or Firm* — Rankin, Hill & Clark LLP

(57) ABSTRACT

A casting apparatus for forming a cylinder head. The apparatus is configured to inhibit gate stick by promoting top-down directional solidification of molten metal in the mold cavity by any one or more of specific placement of gate pins in relation to apertures used to deliver molten metal to the mold cavity, circulating a cooling medium through the gate pins in a parallel fashion, configuring the gates so that a volume on the lower side of the gate is larger than a volume on the upper side of the gate, and insulating the inside surfaces of feeder lids and feeder bowls.

13 Claims, 7 Drawing Sheets

CYLINDER HEAD CASTING APPARATUS AND METHODS

BACKGROUND

Several types of casting processes, including expendable mold casting and non-expendable mold casting, are categorized by the type of mold used, for example sand or metal molds. Further categorization varies by the method used to deliver molten metal to the mold.

In these various types of casting processes, it is common for cast objects to be formed from aluminum metal to decrease the overall weight of the object. Problems may arise from using aluminum metal for casting due to the fact that the volume of aluminum is reduced as it transitions from a liquid state to a solid state, i.e. as it cools to form a cast object. These problems can stem from the design of the mold and/or the process used for solidifying molten metal in the mold.

BRIEF DESCRIPTION

In one aspect, a metal casting apparatus is provided for casting a cylinder head. The casting apparatus includes a mold defining a mold cavity and including an aperture through which molten metal is delivered to the mold cavity for casting the cylinder head. The casting apparatus also includes a gate pin at least partially positioned in the mold cavity, the gate pin defining an interior cooling passage for circulating a cooling medium therein. A distance between the aperture and the interior cooling passage of the gate pin is less than a width of the aperture.

In another aspect, a metal casting apparatus is provided for casting a cylinder head. The casting apparatus includes a mold defining a mold cavity for casting the cylinder head. The casting apparatus also includes gate pins insertable into the mold cavity, each gate pin defining an interior cooling passage for circulating a cooling medium therein. The casting apparatus also includes gates in fluid communication with the mold cavity and configured to deliver molten metal to the mold cavity, each gate including a constricted portion defining an upper side of the gate and a lower side of the gate. A volume of the lower side of the gate is larger than a volume of the upper side of the gate.

In still another aspect, a method is provided for casting a cylinder head by directionally solidifying molten metal in a mold. The method includes providing the mold, with the mold defining a mold cavity and including an aperture through which molten metal is delivered to the mold cavity. The method also includes providing a gate pin insertable into the mold cavity, with the gate pin defining an interior cooling passage for circulating a cooling medium therein. The method also includes positioning the gate pin in the mold cavity such that a distance between the interior cooling passage of the gate pin and the aperture is less than a width of the aperture. The method also includes transporting molten metal through the aperture and to the mold cavity. The method also includes directionally solidifying the molten metal in the mold cavity from a top of the mold to a bottom of the mold by circulating the cooling medium through the interior cooling passage of the gate pin to thereby form the cylinder head.

The present subject matter allows for top-down solidification through the mass of the molten metal in the mold cavity and inhibits the formation of a shrink plane in the gate portion of the cast object. Accordingly, the methods and apparatuses provided herein inhibit gate stick when casting aluminum objects using low pressure permanent mold (LPPM) casting methods.

DETAILED DESCRIPTION

Figure 1:
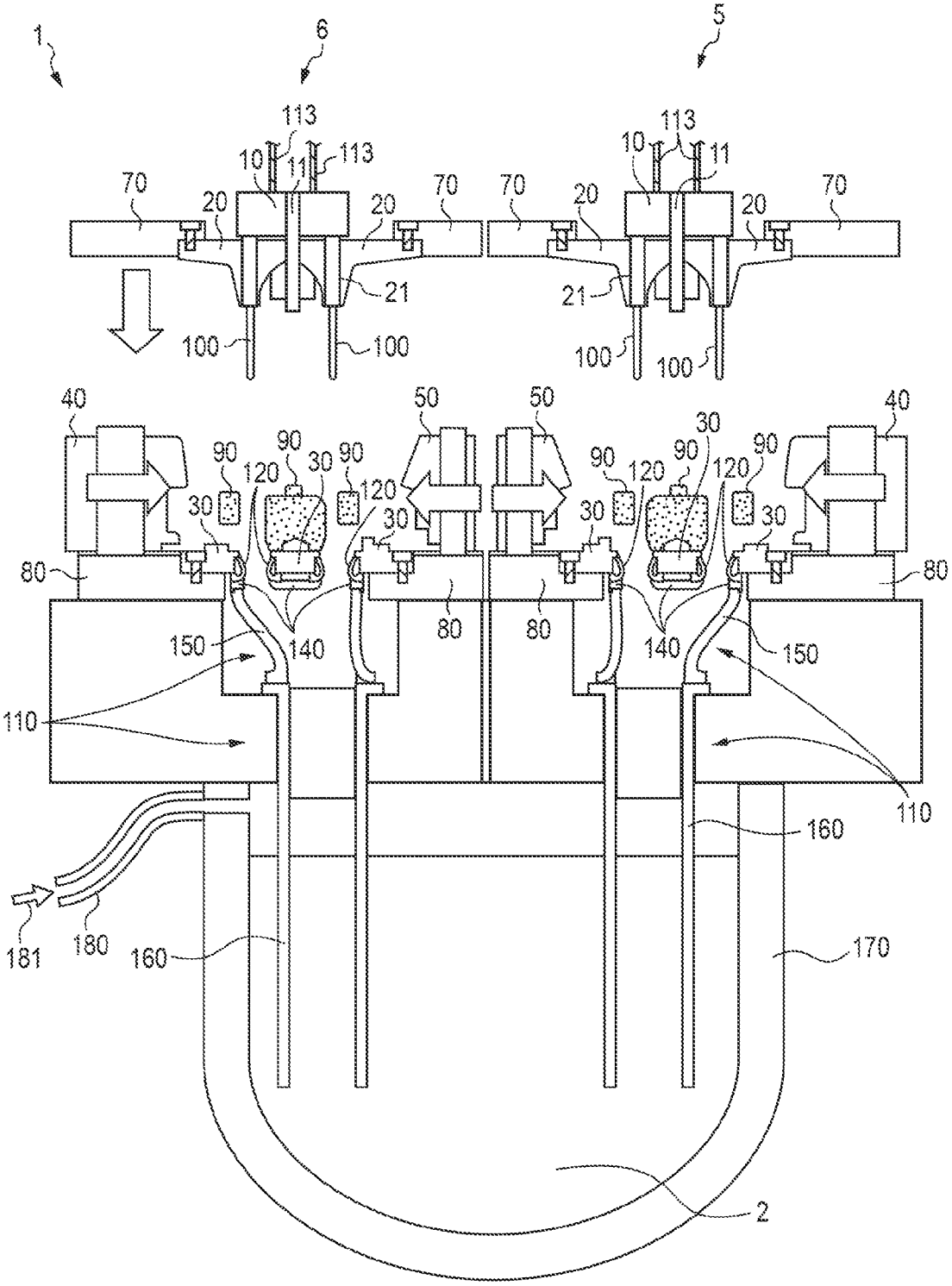
FIG. 1 is a schematic cross-sectional drawing of a casting apparatus in an open state in accordance with the present application.

One method of delivering molten metal to a permanent mold is known as low pressure permanent mold (LPPM) casting. LPPM casting is capable of casting intricate metal parts. One such part is a cylinder head for use in internal combustion engines. It is common for cylinder heads to be formed from aluminum metal to decrease the overall weight associated with internal combustion engines.

LPPM casting uses a pressurized gas to deliver molten metal from a crucible or pot, to a mold cavity. The crucible is typically located under the mold, and thus the delivery of molten metal works against the effects of gravity. The pressurized gas is applied to the top of the molten metal to force the molten metal up through one or more conduits and into the bottom of the mold. The one or more conduits are collectively referred to herein as a "gating system".

Gating systems used to deliver the molten metal to the mold cavity may include a configuration to deliver molten metal through more than one aperture in the bottom of the mold, and thus include several divergent conduits. As the molten metal is delivered to the mold cavity through these one or more conduits, the flow of the molten metal is regulated in each of the conduits by a constricted portion in the conduits, herein referred to as a "gate."

In some LPPM casting systems, one gate is associated with each aperture in the bottom of the mold. The gates typically include a constricted portion through which the flow of molten metal is slowed and is delivered to the mold cavity with decreased turbulence, thereby improving various properties of the cast object.

Like other casting methods, the use of aluminum in LPPM casting can result in a decrease in volume between the molten metal and the solidified cast object. The change in volume of the metal upon transitioning from a liquid state to a solid state will be referred to herein as "shrink" or "shrinking." In LPPM, shrinking can cause various problems, one of which is associated with a phenomenon referred to herein as "bi-directional solidification."

What is meant by the term "bi-directional solidification", is solidification of molten metal in a direction from the top of the casting apparatus towards the bottom of the casting apparatus (i.e. "top-down solidification"), and at the same time, solidification of molten metal in a direction from the bottom of the casting apparatus towards the top of the casting apparatus (i.e. "bottom-up solidification").

In bi-directional solidification, top-down solidification of molten metal in the casting apparatus meets up with bottom-up solidification in the casting apparatus. The meeting of the two directional solidifications of molten metal produces a void in the cast object as a result of the molten aluminum metal shrinking as it solidifies. This void is referred to herein as a "shrink plane", wherein the strength of the cast object at that shrink plane is weaker than in other areas of the cast object resulting in a loss of structural integrity at the shrink plane.

One issue that can arise from bi-directional solidification and the weakness resulting at the shrink plane, is a problem referred to herein as "gate stick." Gate stick arises when molten metal in the mold solidifies bi-directionally, such that molten metal located in the gate of the casting apparatus begins to solidify in a direction from the bottom of the gate towards the top of the gate, while at the same time molten metal in the mold cavity is solidifying from the top of the mold to the bottom of the mold. The portion of the cast object or molten metal located in the gate of the casting apparatus is also commonly referred to as a "gate". However, to avoid confusion with the "gate" (i.e. constricted portion) of the gating system, the portion of the cast object or molten metal located in the gate will be differentiated therefrom by being referred to herein as the "gate portion" of the cast object or of the molten metal.

In some situations, bi-directional solidification produces a shrink plane in the gate portion of the cast object, and particularly the gate portion formed in the upper side of the gate. This shrink plane results in weakness in the gate portion. In attempting to remove the cast object from the mold cavity, shrink planes in the gate portion often inhibit easy removal of the cast object from the mold. Typically, a part of the gate portion or the entire gate portion located below the shrink plane can break from the cast object and become stuck in the gate of the casting apparatus, i.e. gate stick. Gate stick requires effort and time in removal of the gate portion from the gate, resulting in down time for the casting apparatus.

The methods and apparatuses described herein address the formation of a shrink plane by promoting top-down solidification through the mass of the molten metal in the mold cavity and inhibiting bottom-up solidification and the formation of a shrink plane in the gate portion of the cast object. Accordingly, gate stick can be inhibited when casting aluminum objects using LPPM casting methods.

The instant description provides a casting apparatus(es) and a method(s) that addresses gate stick arising from the use of molten aluminum as the casting material. The casting apparatus(es) provided herein can be used for casting a cylinder head or for forming other cast objects. The casting apparatus(es) and related method(s) address bi-directional solidification of the molten aluminum, thereby inhibiting gate stick in casting operations.

The instant disclosure provides several aspects, that when used alone or in combination, promote top-down solidification of the molten metal in the casting apparatus and inhibit bottom-up solidification, thereby inhibiting the formation of a shrink plane in the gate portion of the cast object. When primarily only top-down solidification of molten metal in the casting apparatus occurs, shrink plane formation in the gate portion is eliminated or sufficiently reduced in order to inhibit gate stick. In the absence of, or reduction in, the formation of a shrink plane within the gate portion, gate stick is reduced and the gate portion does not break off from the rest of the cast object upon removal from the casting apparatus.

The casting apparatuses and methods provide top-down solidification of the molten metal within the casting apparatus, thereby forcing shrink due to solidification of the molten metal, in a direction towards the bottom of the casting apparatus. Accordingly, molten metal in the upper side of the gate solidifies before molten metal in the lower side of the gate, thereby producing a gate portion that is substantially free of a shrink plane. In primarily top-down solidification situations, such as that provided for herein, the molten metal in the bottom portion of the gate remains liquid throughout the LPPM casting process; and when pressure is withdrawn from the casting apparatus, the molten metal in the bottom portion of the gate, and in the rest of the gating system, returns through the gating system into the crucible.

Accordingly, upon removal of the cast object from the mold, the gate portion does not break off from the rest of the cast object because no shrink plane has been formed therein, or if present, because the shrink plane provides enough support within the gate portion to prevent gate stick. As the cast object is removed from the mold, the gate portion is also removed from the gate. As such, the bottom of the mold, including the various gates, remains clear and unobstructed for subsequent casting operations. The casting apparatus can then immediately be used for subsequent casting operations without requiring removal of stuck gate portions.

In one embodiment in accordance with the present subject matter, gate stick in a casting apparatus for casting a cylinder head is addressed by including gate pins positioned in the mold cavity above each gate. The gate pins include an elongated body having an elongate interior cooling passage, which is used for circulating a cooling medium in the gate pins. The gate pins are positioned within the mold cavity such that one gate pin is paired with each aperture in the bottom of the mold. In one aspect, one gate pin is positioned above each aperture. In another aspect, the gate pins are positioned such that the distance between the aperture in the bottom of the mold and the interior cooling passage of the gate pin is less than the width of the aperture. In another aspect, the interior cooling passage of the gate pin extends towards the gate such that a distance between the gate and the interior cooling passage is less than 10 millimeters (mm), and in some circumstances, less than 7 mm.

In another embodiment in accordance with the present subject matter, the gates are configured such that a volume of the lower side of the gate is greater than a volume of the upper side of the gate. Having a gate with a larger volume on the lower side inhibits molten metal in the lower side of the gate from solidifying before top-down solidification reaches the molten metal in the upper side of the gate Accordingly, bottom-up solidification is inhibited and a shrink plane does not form in the gate portion of the cast object. Molten metal in the upper portion of the gate solidifies from the top down, while molten metal in the lower side of the gate does not solidify, but rather is returned to the crucible when the application of pressurized gas is discontinued and gate stick is thereby inhibited.

In another embodiment in accordance with the present subject matter, the gating system includes a feeder bowl and a feeder lid. In order to inhibit the formation of a shrink plane in the gate portion of the cast object, one or both of the feeder bowl and the feeder lid are insulated on an inside surface thereof. When referring to the "inside," "inner," "interior," or "outside," "outer," or "exterior" of a particular component, it will be understood that "inside," "inner," "interior," may refer to a portion of the component that comes into contact with the molten metal during a casting process and that "outside," "outer," or "exterior" of a component may refer to a portion on an opposite side of the component from the inside.

Insulation of the inside surfaces of the feeder bowl and lid promote heat retention in the molten metal located in and near the gates. Retention of heat in the molten metal in the gates inhibits bottom-up solidification of the gate portions. Rather, the molten metal in the gates remains liquid until top-down solidification travels through the mass of the molten metal from the top of the casting apparatus and reaches the gates and solidifies the gate portions of the cast object. When top-down solidification reaches to a sufficient extent within the casting apparatus, which is usually before reaching the lower side of the gate, the pressurized gas is withdrawn and any remaining molten metal is returned to the crucible. Such directional solidification of the molten metal inhibits shrink planes from forming in the gate portions. Rather, bi-directional solidification is inhibited and the molten metal solidifies from the top of the mold to the bottom of the mold and then into the gate. The insulation on the inside surfaces of the feeder bowl and the feeder lid keep the molten metal in the lower side of the gate molten until solidification in the upper side of the gate is sufficiently complete.

The various aspects of the present subject matter as described herein can be used individually, or in combination, to promote top-down directional solidification of molten metal in order to produce a cast object, such as a cylinder head for an internal combustion engine, and to inhibit gate stick. The various aspects will now be described in more detail in reference to the figures.

In reference to FIGS. 1-5 and 7, therein is shown a casting apparatus 1 in accordance with the present subject matter, and other various detailed views thereof. The casting apparatus 1 is shown to include a crucible 170 for holding molten metal 2; a mold including mold sections 20, 30, 40, 50 that when brought together define a mold cavity 60 for casting an object out of molten metal 2; a gating system 110 for delivering molten metal 2 to the mold cavity 60; a tube 180 for delivering a pressurized gas 181 to the molten metal 2 to drive the molten metal 2 up through the gating system 110 and a gate 200 to the mold cavity 60 in order to form a cast object 3; a copper cooling block 10 used to directionally cool the molten metal from a top of the apparatus 1 to a bottom of the apparatus 1; gate pins 100 used to circulate a cooling medium for cooling the molten metal; and sand cores 90 within the mold cavity, used to define interior voids in the cast object 3.

The casting apparatus 1 includes a bifurcated casting system including a right side 5, and a left side 6, which are configured to form two cast objects 3 per casting cycle. The configuration of the casting apparatus 1 and the number of cast objects 3 that can be formed by the casting apparatus 1 is not particularly limited, and can include a configuration wherein more or less cast objects 3 are formed per casting cycle.

The several mold sections of the casting apparatus 1 include upper molds 20, lower molds 30, and side molds 40, 50 that when brought together (FIGS. 3 and 7) collectively define one or more mold cavities 60. The number and configuration of the mold sections is not specifically limited, and can include more or less sections than that described herein. The upper mold 20 is connected to an upper platen 70 while the lower mold 30 is connected to a lower platen 80.

Figure 2:
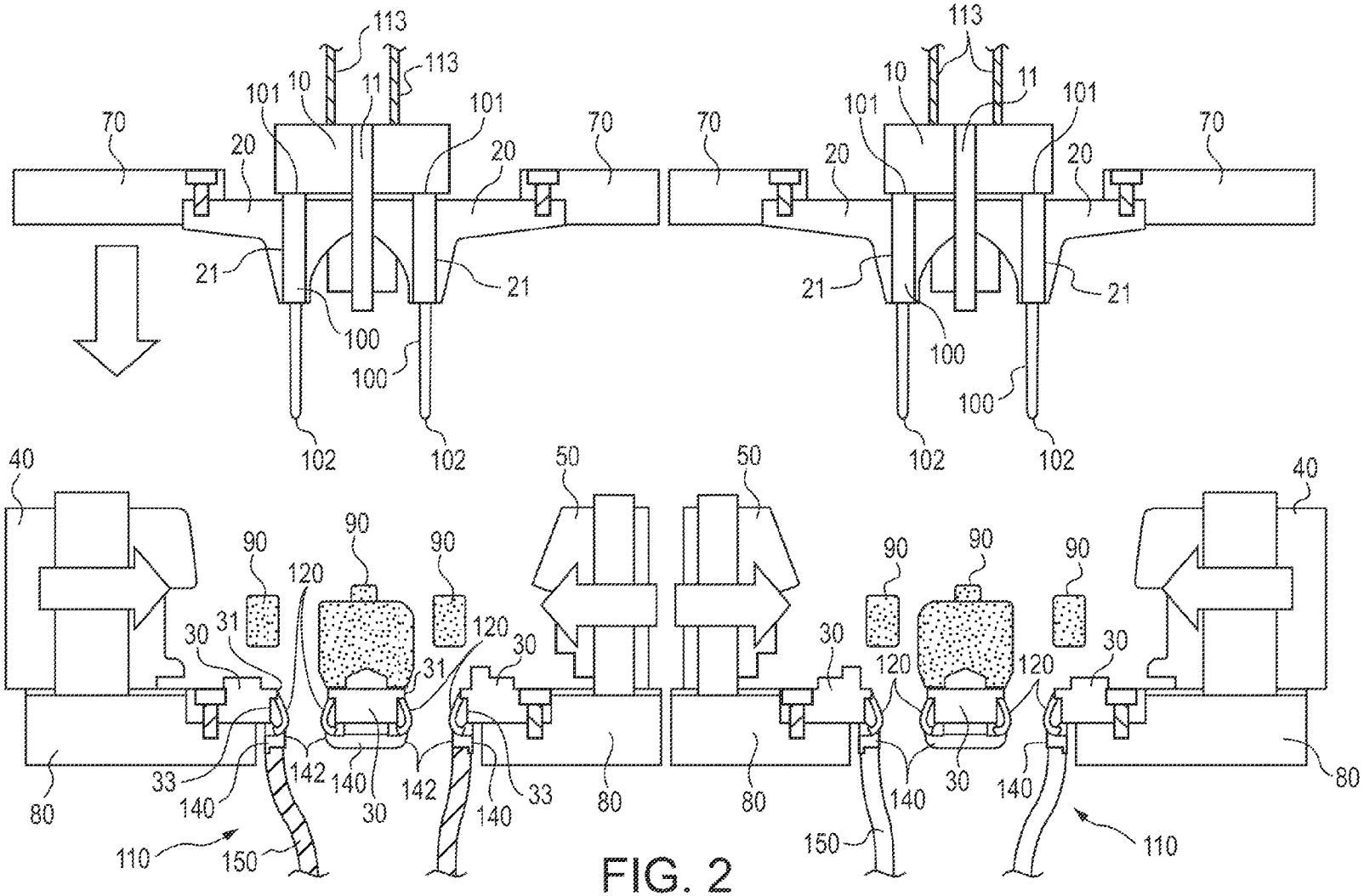
FIG. 2 is a schematic cross-sectional drawing of a top portion of a casting apparatus in an open state in accordance with the present application.
Figure 3:
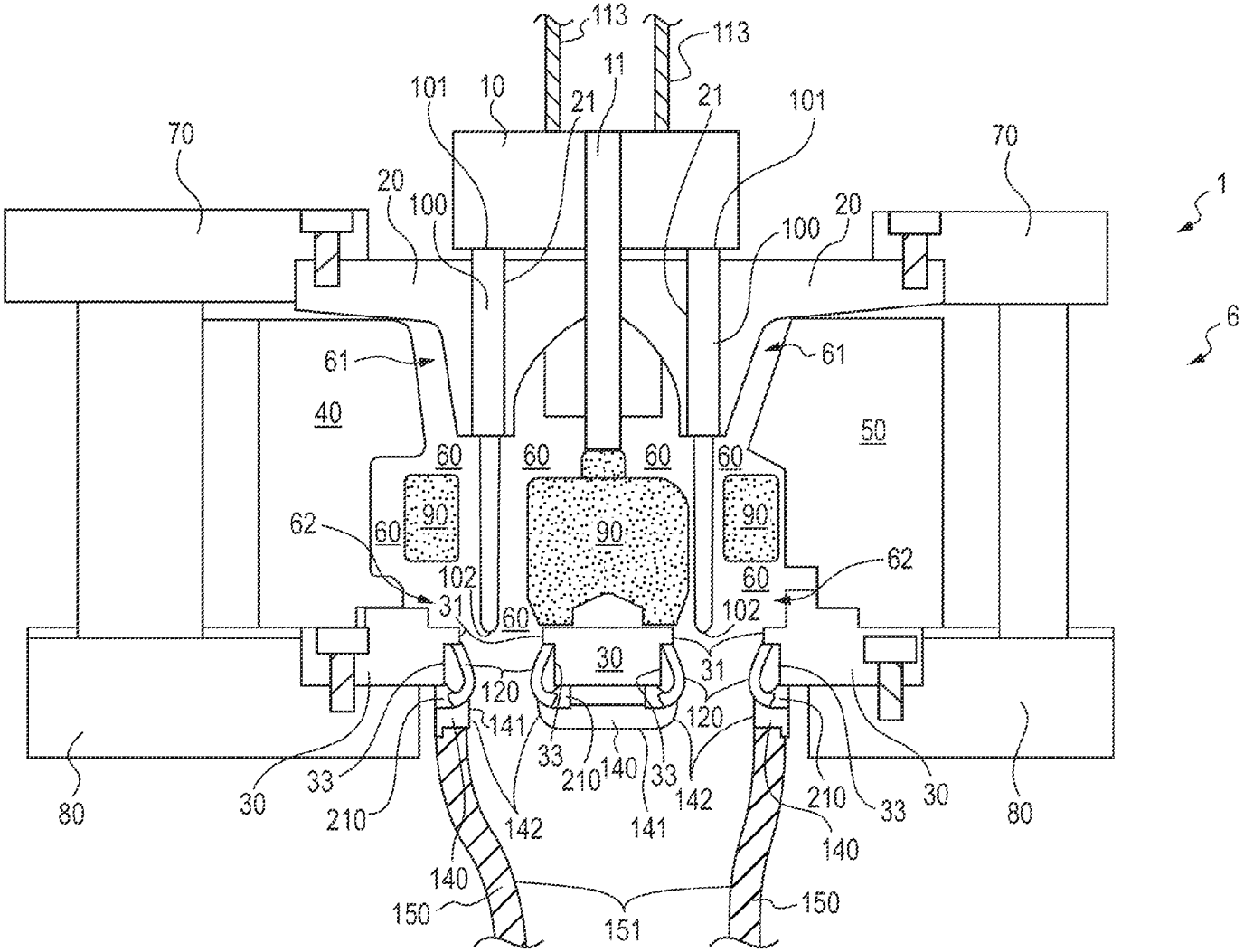
FIG. 3 is a schematic cross-sectional drawing of a top left portion of a casting apparatus in a closed state in accordance with the present application.

In FIGS. 1-2, the casting apparatus 1 is shown in an open, initial position, wherein the mold sections 20, 30, 40, and 50 have not been brought together to define a mold cavity 60 and wherein molten metal 2 has not been delivered to the mold cavity 60. In the open position, as shown in FIG. 1, the side molds 40, 50 are spread a distance apart and do not at this point, define a mold cavity 60. As indicated by the arrows in FIG. 1, mold sections 20, 30, 40, 50 can be moved in relation to each other so as to define a mold cavity 60 as depicted in FIG. 3. FIG. 2 is a more detailed depiction of the casting apparatus 1, which for clarity, does not show the crucible 170 and stalks 160. The casting apparatus 1 is shown in FIG. 2 in an open configuration, similarly to FIG. 1.

In order to define a mold cavity 60, the upper platen 70 will be moved towards the lower platen 80 and side molds 40, 50 will be moved in towards each other and in contact with the lower mold 30 and the upper mold 20, as depicted in FIG. 3. As the upper mold 20, side molds 40, 50 and lower mold 30 are moved together, they collectively define a mold cavity 60. FIG. 3 depicts the left side 6 of the casting apparatus 1, wherein the mold sections 20, 30, 40, and 50 have been brought together to define the mold cavity 60 and wherein molten metal has not yet been delivered to the mold cavity 60.

Figure 7:
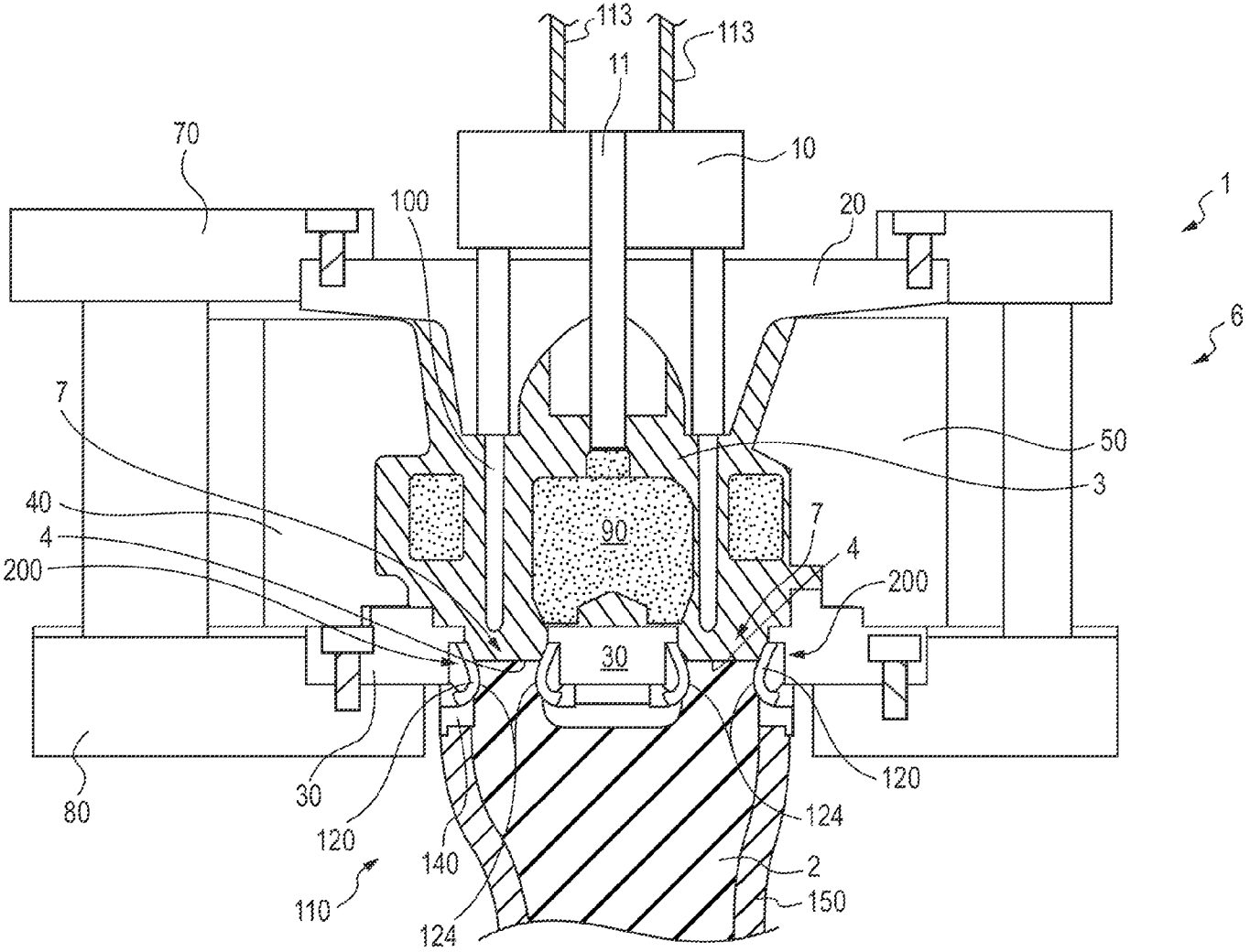
FIG. 7 is a schematic cross-sectional drawing of a top-left portion of a casting apparatus in a closed state and having a cast object in the mold cavity in accordance with the present application.

FIG. 7 depicts the left side 6 of the casting apparatus 1, wherein the mold sections 20, 30, 40, and 50 have been brought together to define the mold cavity 60 and wherein molten metal 2 has been delivered to the mold cavity 60. As can be seen, the molten metal in the mold cavity 60, and some in the gate 200, has cooled to define a cast object 3 including a gate portion 7 and a bottom 4 of the cast object 3. Molten metal 2 below the bottom 4 of the cast object 3 has not cooled and still remains in liquid form.

As shown in FIGS. 1-3, the casting apparatus 1 includes a copper cooling block 10 in intimate contact with an outer/upper surface of the upper mold 20. The copper cooling block 10 is used to promote top-down directional solidification of molten metal in the mold cavity 60. During a casting process, cooling medium is directed through orifices (not shown) in the copper cooling block 10 such that heat transfers out of the molten metal 2 in the cavity 60, through the upper mold 20, and into the copper cooling block 10 for dissipation by the cooling medium. The use of the copper cooling block 10 promotes top-down solidification, wherein molten metal near the upper mold 20 (i.e. at a top 61 of the mold cavity 60) solidifies before molten metal near the side molds 40, 50 or lower mold 30 (i.e. at a bottom 62 of the mold cavity 60). Further, the upper mold 20 includes holes 21 through which one or more gate pins 100 are inserted.

Also passing through the upper mold 20 and the copper cooling block 10 is a vent 11 used to vent gases produced in the casting process when components in the sand cores 90 volatilize. As shown in FIGS. 1-3 and 7, sand cores 90, including various combustible materials, such as binders, are included to form voids in the cast object 3. During casting, the sand cores 90 are exposed to the heat of the molten metal 2. In response, the combustible materials in the sand cores 90 combust, burn, or otherwise emit gases. Such gases can be expelled through the vent 11 passing through the upper mold 20 and the copper block 10.

Figure 4:
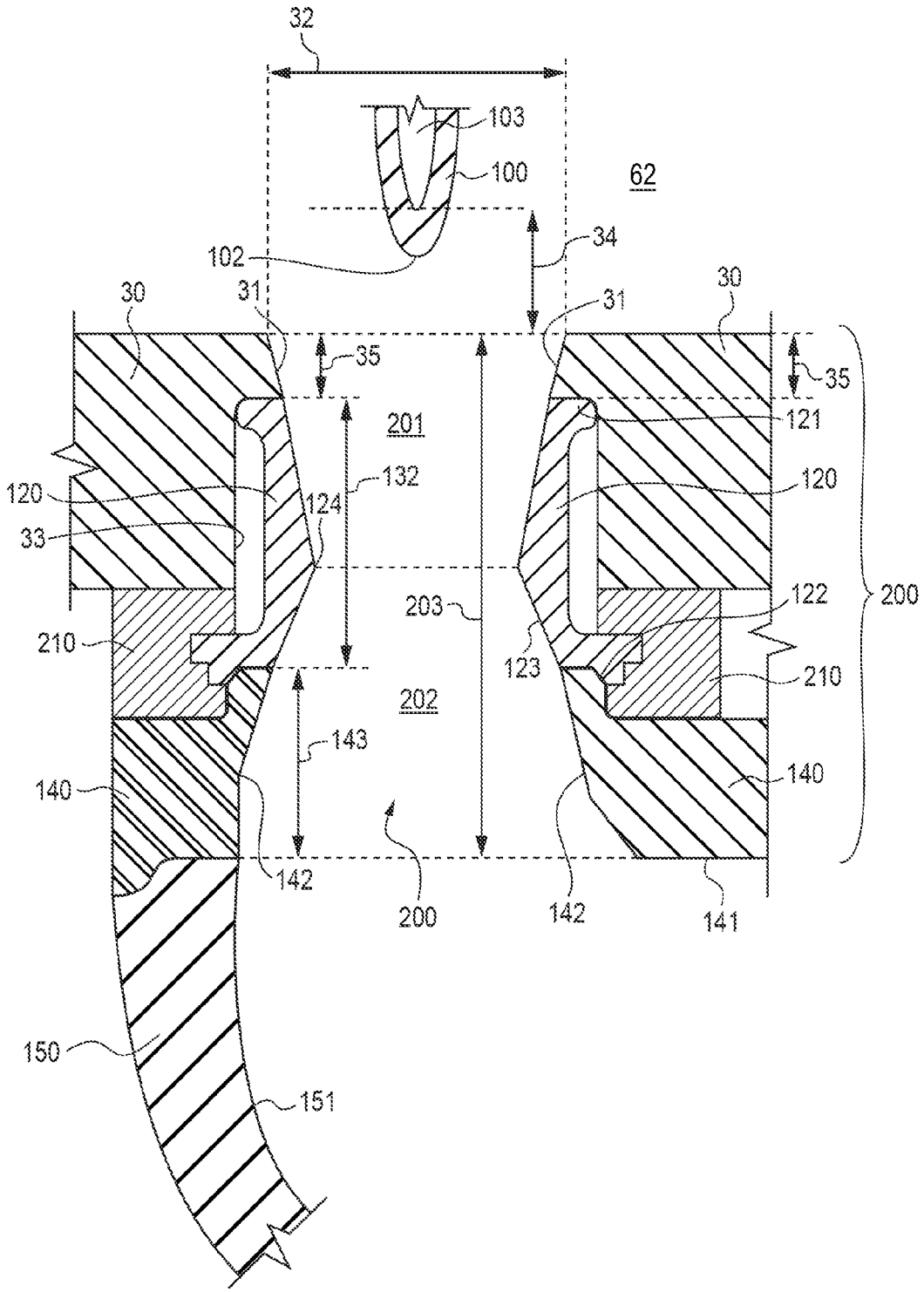
FIG. 4 is a schematic cross-sectional drawing of a gate portion of a casting apparatus in accordance with the present application.

The lower mold 30 includes one or more apertures 31 provided to be in fluid communication with the mold cavity 60 when the mold cavity is formed by the upper mold 20, side molds 40, 50 and lower mold 30, such that molten metal 2 is transported through the apertures 31 and into the mold cavity 60. The apertures 31 have a width 32 measured laterally across the aperture 31 and a length 35 measured perpendicular to the width 32, as indicated in FIG. 4. Although a plurality of apertures 31 is provided in order to more evenly distribute molten metal to the various portions of the mold cavity 60, it will be understood that the casting apparatus 1 can include more or less apertures 31 per lower mold 30, including a lower mold 30 having only one aperture 31.

The lower mold 30 is attached to the lower platen 80 and includes lower cavities 33 on an exterior portion of the lower mold 30 in alignment with the apertures 31. In one embodiment, the lower mold 30 includes one or more lower cavities 33. The lower cavities 33 lie on a side of the lower mold 30 opposite the mold cavity 60, i.e. the outside of the lower mold 30. Alignment of the lower cavities 33 with the apertures 31 is clearly depicted in FIGS. 3 and 4. A gate insert 120 sits at least partially within the lower cavities 33 of the lower mold 30. In accordance with the present subject matter, one lower cavity 33 is aligned with each aperture 31 as shown and has one gate insert 120 inserted therein. As depicted therein, the gate insert 120 is connected to the lower mold 30 by using a retainer 210. The retainer 210 is configured to secure the gate insert 120 to the lower mold 30, wherein the gate insert 120 sits at least partially within the lower cavity 33.

The casting apparatus 1 further includes a gating system 110 including gate inserts 120, feeder lids 140, feeder bowls 150, and stalks 160. The gating system 110 is configured to deliver molten metal 2 from the crucible 170 to the mold cavity 60.

As shown in FIG. 1, two stalks 160 are in direct fluid communication with the molten metal 2 in the crucible 170 and are thereby able to take up the molten metal 2 from the pressurized interior of the crucible 170. Each of the stalks 160 are connected to an associated bowl 150, and are in direct fluid communication with the interior of the crucible 170 such that the stalks 160 are able to deliver molten metal 2 from the crucible 170 to the bowl interior.

As shown in FIGS. 2-4, each bowl 150 is connected to an associated lid 140, which fits over the bowl 150. The interior of each bowl 150 is in direct fluid communication with the interior of the associated lid 140, such that molten metal in the bowl 150 contacts the interior of the associated lid 140 and can be delivered through bores 142 in the associated lid 140. Each bore 142 has a length 143 as shown in FIG. 4. Each lid 140 is connected to one or more associated gate inserts 120 and the interior of each lid 140 is in fluid communication with a passage 123 of the associated gate insert 120 such that molten metal in the bowl 150 and lid 140 can be delivered through the bores 142 to the passage 123 of the gate insert 120. Each gate insert 120 is connected to a lower mold 30 and is in fluid communication with one associated aperture 31 in the lower mold 30 such that that molten metal in the passage 123 can be delivered to the aperture 31. Each aperture 31 in the lower molds 30 is in fluid communication with the mold cavity 60 such that molten metal can be delivered to the mold cavity 60 through the apertures 31.

The bowl 150 and lid 140 are configured to distribute molten metal 2 to different portions of the mold cavity 60. In one embodiment, the lid 140 and bores 142 operate together in order to segregate the molten metal 2 in the bowl 150 to the various gates 200, which are connected at different locations on the mold and deliver molten metal 2 to different portions of the mold cavity 60. Referring now to FIGS. 3-4, the bores 142 in the lid 140 are aligned with gate inserts 120, which are aligned with the apertures 31 located at different locations in the lower mold 30. In this way, the bowls 150 are in fluid communication with the mold cavity 60 and thereby deliver the molten metal to various portions of the mold cavity 60.

The casting apparatus 1 is configured such that pressurized gas 181 is delivered to the crucible 170 through a pressurized gas tube 180. As the gas 181 pressurizes the interior of the crucible 170, molten metal 2 in the crucible 170 is forced up through the stalk 160 and into the bowls 150, through bores 142 in the lid 140, through the gate insert 120, through the apertures 31 in the lower mold 30, and into the mold cavity 60.

As can be seen in FIG. 1, the molten metal 2 in the crucible 170 can be delivered through the gating system 110 to the mold cavity. That is, the stalks 160 are in fluid communication with the bowls 150, which are in fluid communications with the lid 140, which are in fluid communications with the gate inserts 120, which are in fluid communication with the apertures 31 in the lower mold 30, which are in fluid communication with the mold cavity 60. Thereby, as pressurized gas 181 is delivered to the interior of the crucible 170, molten metal 2 is delivered to the mold cavity 60 through the various components of the gating system 110.

Figure 5:
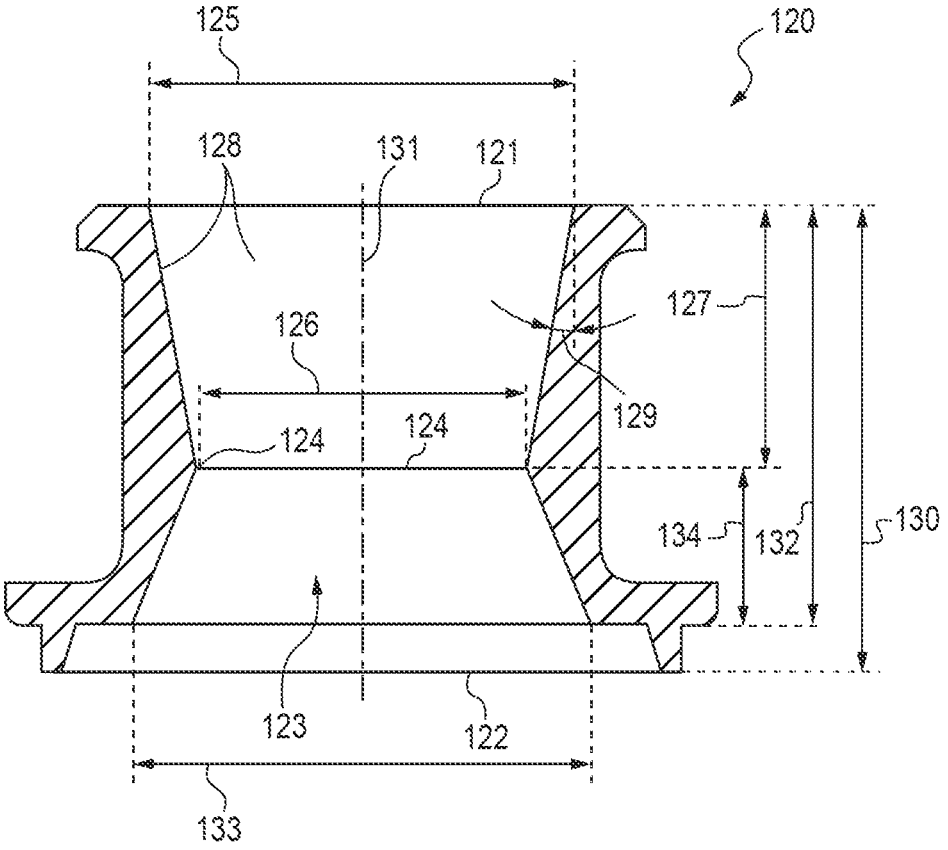
FIG. 5 is a schematic cross-sectional drawing of a gate insert in accordance with the present application.

FIG. 5 depicts a gate insert 120 in isolation from other components of the casting apparatus 1. Therein the gate insert 120 is shown to have a first end 121 and a second end 122. The gate insert 120 includes a passage 123 that extends from the first end 121 towards the second end 122, which may or may not extend all the way to the second end 122. The gate insert 120 includes a throat 124 defined by a constricted portion in the passage 123. The throat 124 of the gate insert 120 is configured to at least partially regulate the flow of molten metal into the mold cavity 60. The gate insert 120 has a length 130, defined as the measurement between the first end 121 and the second end 122 along a longitudinal axis 131. The passage 123 can have the same length as the length of the gate insert 120, or can have a different length as shown in FIG. 5, such that the length 132 of the passage 123 is shorter than the length 130 of the gate insert 120.

When the gate insert 120 is inserted into the lower cavity 33 of the lower mold 30, the first end 121 of the gate insert 120 is positioned adjacent to the aperture 31 as seen in FIG. 4. The passage 123 of the gate insert 120 is thereby in fluid communication with the mold cavity 60 through the apertures 31 in the lower mold 30. The second end 122 of the gate insert 120 is positioned adjacent to the bore 142 of the lid 140. The passage 123 is thereby in fluid communication with the interior of the lid 140 and bowl 150 by way of the bore 142. In one aspect (FIG. 4), a portion of the bore 142 of the lid 140 sits partially within the gate insert 120. In this aspect, the length 132 of the passage 123 does not extend the full length 130 of the gate insert 120.

In one embodiment as shown in FIGS. 4 and 5, the length 132 of the passage 123 is shorter than the length 130 of gate insert 120, because a portion of the lid 140 sits inside the gate insert 120 when they are connected. The passage 123 of the gate insert 120 has a width 125 at the first end 121, defined as a measurement across the passage 123 at the first end 121 in a direction perpendicular to the longitudinal axis 131 of the gate insert 120. The passage 123 has a width 126 at the throat 124 defined as a measurement across the passage 123 at the throat 124, in a direction perpendicular to the longitudinal axis 131 of the gate insert 120. The passage 123 of the gate insert 120 has a width 133 at the second end 122, defined as a measurement across the passage 123 at the second end 122 in a direction perpendicular to the longitudinal axis 131 of the gate insert 120. The passage 123 has a distance 127 from the first end 121 of the passage 123 to the throat 124 that is measured in a direction parallel to the longitudinal axis 131 of the gate insert 120. The passage 134 has a distance 134 from the throat 124 to the end of the passage nearest the second end 122 of the gate insert 120 that is measured in a direction parallel to the longitudinal axis 131 of the gate insert 120.

The passage 123 is partially defined by a passage wall 128 that extends between the first end 121 and the throat 124 as indicated in FIG. 5. The wall 128 flares out from the throat 124 to the first end 121 at an angle 129 as shown (herein referred to as the "draft angle" of the gate insert 120). The draft angle 129 is defined as the angle between the wall 128 and the longitudinal axis 131 of the gate insert 120. In one embodiment, the draft angle 129 of the passage wall 128 is between 8 degrees and 10 degrees. In another embodiment, an upper portion of the gate insert 120 is defined by the portion of the passage 123 between the throat 124 and the first end 121, which defines the wall 128. Further, the lower portion of the gate insert 120 is defined by the portion of the passage 123 between the throat 124 and the end of the passage 123 nearest the second end 122 of the gate insert 120. In one aspect, the distance 127 from the first end 121 of the passage 123 to the throat 124 of the gate insert 120 is greater than about 30 mm, and in one aspect is greater than about 33 mm.

As depicted in detail in FIG. 4, the casting apparatus 1 includes one or more gates 200 to regulate flow of molten metal from the crucible 170 to the mold cavity. In one aspect, the gates 200 sit directly between the mold cavity and the bowl 150 and directly and fluidly link the mold cavity and the bowl 150.

Each gate 200 in the casting apparatus 1 is defined by the aperture 31 in the lower mold 30, the passage 123 in the gate insert 120, and the bore 142 in the lid 140. The length 203 of the gate 200 is defined by the length 35 of the aperture 31 in the lower mold 30, the length 132 of the passage 123 in the gate insert 120, and the length 143 of the bore 142 of the lid 140. As shown in FIG. 4, an upper side 201 of the gate 200 is defined by the portion of the gate 200 located above the throat 124 of the gate insert 120. A lower side 202 of the gate 200 is defined by the portion of the gate 200 located below the throat 124 of the gate insert 120. In this configuration, as shown in FIG. 4, a width of the gate 200 at the mold cavity 60 is defined by the width 32 of the aperture 31.

In one embodiment, the volume of the lower side 202 of the gate 200 is greater than the volume of the upper side 201 of the gate 200. A greater volume in the lower side 202 of the gate 200 allows for a greater amount of molten metal to occupy the lower side 202 of the gate 200. This greater amount of molten metal in the lower side 202 of the gate 200 provides a greater amount of heat in the lower side 202 of the gate 200, which can then be retained for a longer period of time in the molten metal 2. Accordingly, molten metal in the lower side 202 of the gate 200 will not solidify before molten metal in the upper side 201 of the gate 200.

In other words, as molten metal begins to directionally solidify from the top of the casting apparatus 1 towards the bottom of the casting apparatus 1, because of the larger volume on the lower side 202 of the gate 200, molten metal in the lower side 202 of the gate 120 remains molten and does not solidify before formation of the gate portion 7 of the cast object 3. Rather, molten metal will solidify through the mold cavity 60 and then only in a portion of the upper side 201 of the gate 201 to form the cast object 3 including the gate portion 7. At this point, molten metal still contained within the lower side 202 of the gate 200 will be returned to the crucible 170 by releasing pressure from the crucible 170 by discontinuing the delivery of pressurized air to the crucible 170. In this way, gravity will draw any molten metal out of the gating system 110, and specifically in the lower side 202 of the gate 200, and back into the crucible 170. The cast object 3 including the gate portion 7, can then be removed from the molds without undesirable gate stick.

In one aspect and in reference to FIG. 5, the gate insert 120 is configured, such that a ratio of the width 133 of the passage 123 at the second end 122 to the width 125 of the passage 123 at the first end 121 is greater than about 1:1. In other words, the width 133 of the passage 123 at the second end 122 is greater than the width 125 of the passage 123 at the first end 121. Because the gate insert 120 defines a portion of the gate 200, such configuration of the gate insert 120 contributes to having a larger volume in the lower side 202 of the gate 200 than in the upper side 201 of the gate 200; thereby promoting heat retention in the larger volume of the molten metal in the lower side 202 of the gate 200 and inhibiting gate stick. In contrast, if the width 133 of the passage 123 at the second end 122 was less than the width 125 of the passage 123 at the first end 121, then the configuration of the gate insert 120 would not contribute to having a gate 200 with a lower side 202 having a larger volume than the volume of the upper side 201, and thereby may result in increased occurrences of gate stick.

In another aspect, the gate insert 120 is configured, such that the distance 127 between the first end 121 and the throat 124 promotes solidification of molten metal in the mold cavity 60 before solidification of molten metal in the gate insert 120. For example, a ratio of the length 132 of the passage 123 to the distance 134 between the second end 122 of the gate insert 120 and the throat 124 can be less than about 3:1. In other words, the distance 134 between the second end 122 of the gate insert 120 and the throat 124 is greater than about ⅓ the length 132 of the passage 123. In conjunction with the length 143 of the bore 142 of the lid 140, this gate insert 120 configuration contributes to having a larger volume in the lower side 202 of the gate 200 than in the upper side 201 of the gate 200. In contrast, if the distance 134 between the second end 122 of the gate insert 120 and the throat 124 was less than about ⅓ the length 132 of the passage 123, then the configuration of the gate insert 120 would not contribute to having a gate 200 with a lower side 202 having a larger volume than the volume of the upper side 201, and may result in increased occurrences of gate stick.

The gate insert 120 could include one or more of these aspects in order to inhibit molten metal in the gate 200 from solidifying before molten metal in the mold cavity 60, and to thereby inhibit the formation of a shrink plane in the gate portion 7 of the cast object 3.

It will be appreciated that the gates 200 are not particularly limited to a specific structure, but can include more or fewer components than that described herein. More particularly, the gates 200 can be a one-piece structure.

Figure 6:
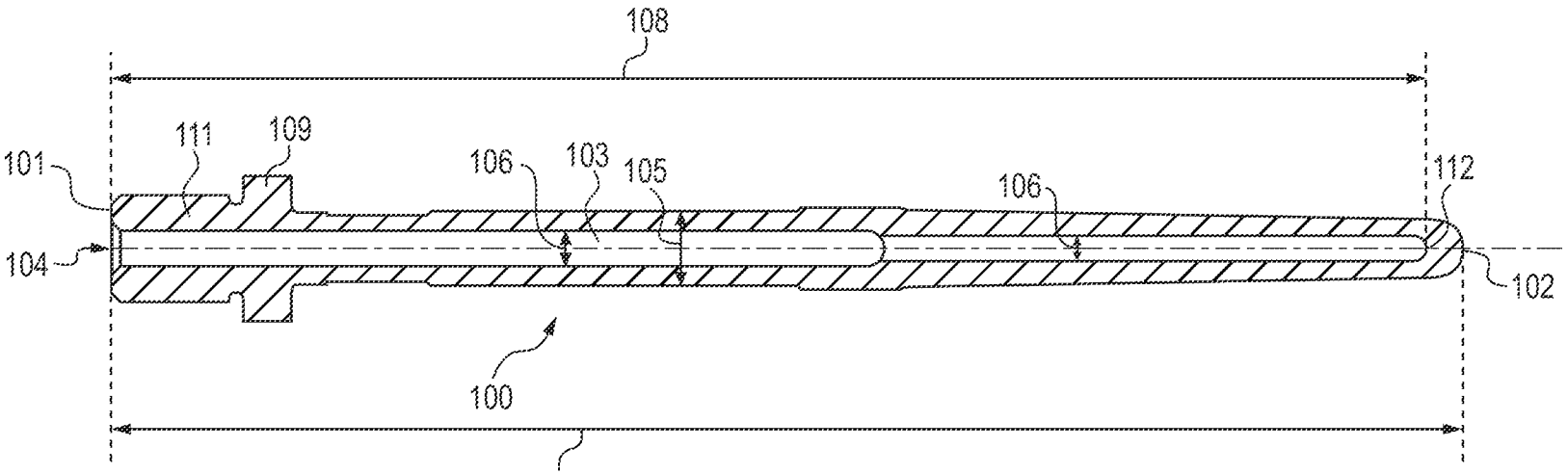
FIG. 6 is a schematic cross-sectional drawing of a gate pin in accordance with the present application.

In one embodiment in accordance with the present subject matter, the casting apparatus 1 includes gate pins 100 as can be seen in FIGS. 1-3, and separately in detail in FIG. 6. In one embodiment, when the various mold sections 20, 30, 40, and 50 are in a closed state, the gate pins 100 are inserted through holes 21 in the upper mold 20 and extend into the interior of the mold cavity 60, and toward the apertures 31 in the lower mold 30 (FIGS. 3 and 7). In one aspect, the gate pins 100 are attached to or inserted through the copper cooling block 10 and one gate pin 100 is paired with each aperture 31 in the lower mold 30 as shown in the figures. As can be seen in FIGS. 1-3 and 7, the casting apparatus 1 includes a plurality of gate pins 100, wherein one gate pin 100 is associated with each aperture 31 in the lower mold 30.

FIG. 6 depicts a gate pin 100 including an elongated cylindrical-type body defining a first end 101 and a second end 102. The gate pin 100 includes an interior cooling passage 103 for the circulation of cooling medium therein. The interior cooling passage 103 is opened at the first end 101 and connected to the copper cooling block 10. The opening 104 at the first end 101 is in fluid communication with a circulating channel 113 (FIGS. 1-3) and is used to introduce the cooling medium to the interior cooling passage 103. The second end 102 of the gate pin 100 is closed such that cooling medium circulated in the interior cooling passage 103 of the gate pin 100, does not comingle with and contaminate the molten metal delivered to the mold cavity 60 during a casting process. In one embodiment as shown in FIG. 6, each gate pin 100 has a lip 109 near the first end 101. The lip 109 defines a head 111 including the portion of the gate pin 100 between the lip 109 and the first end 101. This lip 109 acts as a stop for the gate pin 100 when inserted through holes 21 in the upper mold 20 or when inserted through the copper cooling block 10. Accordingly, the lip 109 and the head 111 include portions of the gate pin 100 that do not enter into the mold cavity 60 and do not enter into the holes 21 in the upper mold 20.

When referring to a width 105 of the gate pin 100, this means the average width of the gate pin 100, not including the width measurements of the lip 109 or head 111, and only includes the width measurement of the portion of the gate pins 100 between the second end 102 and the lip 109. Likewise, the width 106 of the interior cooling passage 103 is an average width of the interior cooling passage 103 between the second end 102 and the lip 109. In another embodiment, the gate pins 100 are configured such that a ratio of the width 105 of the gate pin 100 to the width 106 of the interior cooling passage 103 is from about 5:1 to about 1.5:1. It will be understood that the width 105 of the gate pin 100 and the width 106 of the interior cooling passage 103 can vary along the length 107 of the gate pin 100.

When the ratio of the width 105 of the gate pin 100 to the width 106 of the interior cooling passage 103 is within this range, the gate pins 100 can efficiently transfer heat out of the molten metal 2 in the mold cavity 60 and into the cooling medium for dissipation. When the ratio of the width 105 of the gate pin 100 to the width 106 of the interior cooling passage 103 is more than 5:1 (i.e. if the width 105 of the gate pin 100 is more than five times the width 106 of the interior cooling passage 103), then the gate pins 100 may not efficiently transfer heat out of the molten metal 2 in the mold cavity 60. Because of this, solidification of the cast object 3 may take more time, thus providing time for molten metal in the lower side 202 of gate 200 to solidify bottom-up to produce a shrink plane in the gate portion 7 of the cast object 3, and resulting in gate stick.

When referring to the length 107 of the gate pins 100, it is meant the length from the first end 101 to the second end 102 of the gate pin 100. When referring to the length 108 of the interior cooling passage 103, it is meant a measurement from the opening 104 to the closed end 112 of the interior cooling passage 103. In one embodiment, the gate pins 100 are configured, such that a ratio of a length 108 of the interior cooling passage 103 is at least 90% of a length 107 of the gate pin 100. In one aspect, the length 108 of the interior cooling passage 103 extends at least 95% of a length 107 of the gate pin 100.

When the ratio of a length 108 of the interior cooling passage 103 of the gate pin 100 is at least 90% of a length 107 of the gate pin 100, the gate pins 100 can efficiently transfer heat out of the molten metal 2 in the mold cavity 60 and into the cooling medium for dissipation. Further, when this ratio is satisfied, solidification of the molten metal 2 in the mold cavity 60 to form the cast object 3 can be accomplished before molten metal in the gate 200 begins to solidify from the bottom-up, thereby avoiding the formation of a shrink plane within the gate portion 7 of the cast object 3. When the ratio of a length 108 of the interior cooling passage 103 of the gate pin 100 is less than 90% of a length 107 of the gate pin 100, the gate pins 100 may not efficiently transfer heat out of the molten metal 2 in the mold cavity 60. Because of this, solidification of the cast object 3 may take more time, thus providing time for molten metal in the lower side 202 of gate 200 to solidify and causing a shrink plane to develop in the gate portion 7 of the cast object 3 resulting in gate stick.

When the mold is closed (i.e. the mold sections 20, 30, 40, and 50 are brought together as depicted in FIG. 3), the gate pins 100 extend in the mold cavity 60, from the top 61 of the mold cavity 60 towards a bottom 62 of the mold cavity 60 at a position located above the apertures 31. In one embodiment, as shown in FIG. 4, the gate pin 100 is positioned in the mold cavity 60, such that the distance 34 between the aperture 31 of the lower mold 30 and the interior cooling passage 103 of the gate pin 100 is less than the width 32 of the aperture 31. In one aspect, a ratio of the distance 34 between the aperture 31 and the interior cooling passage 103, to the width 32 of the aperture 31 is less than 0.5:1. That is, the distance 34 is less than one half the width 32.

When the gate pins 100 are inserted into the mold cavity such that the distance 34 between the aperture 31 and the interior cooling passage 103 less than the width 32 of the aperture 31, then the gate pins 100 are able to provide efficient cooling for the molten metal 2 in the mold cavity 60, and specifically to molten metal in the bottom 62 of the mold cavity 60. Accordingly, the cast object 3 can be formed by solidifying molten metal from the top 61 of the mold cavity 60 all the way to the bottom 62 of the mold cavity 60 before molten metal 2 in the lower side 202 of the gate 200 begins to solidify. Gate stick can thereby be avoided. Conversely, if the distance 34 between the aperture 31 and the interior cooling passage 103 is less than the width 32 of the aperture 31, then the gate pins may not provide efficient cooling to the molten metal 2 in the bottom 62 of the mold cavity 60. Accordingly, more time may be required to solidify molten metal in the bottom 62 of the mold cavity 60 so as to form a cast object 3. The additional time required to form the cast object 3 may allow the molten metal 2 in the lower side 202 of the gate 200 to solidify bottom-up, and may result in gate stick.

In one embodiment, cooling medium is circulated in the interior cooling passages of the gate pins 100 in a parallel fashion. That is, the cooling medium is circulated from a reservoir (not shown) to each gate pin 100 in an independent fashion, such that the cooling medium does not circulate through more than one gate pin 100 before being returned to the cooling medium reservoir to dissipate heat. In this way, each gate pin 100 receives cooling medium directly from the reservoir without first being circulated through another gate pin 100. Circulation of the cooling medium in a parallel fashion in the gate pins 100 during a casting process provides efficient heat transfer from the molten metal in the mold cavity 60 and decreases the time necessary for forming a cast object 3. Further, circulating the cooling medium in a parallel fashion provides uniform cooling of the molten metal 2 in the mold cavity 60 and further promotes top-down directional solidification because molten metal 2 in the lower side 202 of the gate 200 does not solidify before the cast object 3 is formed. Accordingly, the development of a shrink plane in the gate portion 7 of the cast object 3 and associated gate stick is thereby inhibited.

In one embodiment, portions of the casting apparatus 1 include insulation provided on the inside surfaces thereof. Inside surfaces of the casting apparatus 1 may be defined as that portion of the casting apparatus 1 that comes into contact with the molten metal 2 during a casting process. In one aspect, inside surfaces 151, 141 respectively, of the bowl 150 and the lid 140 include insulation. The inside surface 141 of the lid 140 and the inside surface 151 of the bowl 150 (FIGS. 3 and 4), may be defined as that portion of the lid 140 and bowl 150 respectively, that come into contact with the molten metal 2 during a casting process. That is, portions of the lid 140 and bowl 150 that do not come into contact with the molten metal 2 may not define the inside surfaces 141, 151. Insulating the inside surfaces 141, 151 of the lid 140 and bowl 150 enables molten metal in the bowl 150 and the lid 140 to retain heat. Such heat can be transferred to molten metal 2 in the lower side 202 of the gate 200 and thereby keep the molten metal 2 in the lower side 202 of the gate 200 from solidifying from the bottom-up. Thereby, the formation of a shrink plane in the gate portion 7 of the cast object 3 is inhibited. Without insulation, heat from the molten metal in the bowl 150 and the lid 140 is not efficiently retained and may not sufficiently be transferred to the molten metal 2 in the lower side 202 of the gate 200. Thereby, molten metal 2 in the lower side 202 of the gate 200 may lose heat and solidify the gate portion 7 from the bottom-up to cause a shrink plane in the gate portion 7 of the cast object 3.

In one embodiment, the bowl 150 and the lid 140 are insulated with layers including a base layer including a permanent mold coating, a first intermediate layer including a ceramic fiber and permanent mold coating, a second intermediate layer including a permanent mold coating, and a top layer including boron nitrite powder. Such insulating layers help to retain the heat in the molten metal located in the gate 200 and promote top-down solidification such that molten metal in the upper side 201 of the gate 200 solidifies before molten metal in the lower side 202 of the gate 200.

By "permanent mold coating," it is meant a mixture of Top Coat SP-1000, Kaostick, and distilled water. Top Coat SP-1000 is a refractory product that is a chemical mixture of flaked graphite, alumina, distilled water, red oxide, diatom earth, bantonita, and amorphus silica. Top Coat SP-100 is available from Keimei Shoji Company, Osaka, Japan. Kaostick is a binder material including a high temperature mortar adhesive made from aluminum oxide ($Al_2O_3$) and silicon dioxide ($SiO_2$) and is available from K-STEEL KUWAIT, Safat, Kuwait. In one aspect, Top Coat SP-1000, Kaostick and distilled water are added in a ratio of about 1:1:2 to about 1:1:1 and mixed for about 30 minutes or more before use. The mixture is thereafter applied with a brush to the interior surfaces 141, 151 of the bowl 150 and lid 140.

In one aspect, the ceramic fiber used to insulate the bowl 150 and the lid 140 includes Isowool, provided by Isolite Insulating Products Company of Japan. Isowool is a chemical composition including aluminum oxide and silica oxide, wherein the aluminum oxide is contained at 30-60% by weight and the silica oxide is contained at 40-60% by weight. The aluminum and silica compound is melted and fiberized by blowing with centrifugal force to produce a fiber of this product. In one aspect, Isowool 1260 ace paper is used, which includes Isowool bulk material and an organic binder. Isowool 1260 ace paper is applied to the interior surfaces 141, 151 respectively, of the lid 140 and bowl 150 by first applying a permanent mold coating to the Isowool. While the permanent mold coating is still wet on the Isowool, the wetted Isowool is contacted to the interior surfaces 141, 151 of the lid 140 and bowl 150. Thereafter, the wetted Isowool is dried, and another layer of permanent mold coating is applied over the top of the Isowool layer.

In one aspect, boron nitride powder is applied over the various other layers. The boron nitride thereby acts as the exposed inner layer that comes into contact with the molten metal during a casting process. Boron nitride powder is not specifically limited by the present subject matter, and can be in any form and applied in any manner. In one aspect, boron nitride powder is applied in paint form. Boron nitride paint is available under the trade name Lubricoat®, provided by Pyrotek Inc. of Spokane, Wash., USA. The boron nitride can be applied by other various techniques and in other different forms, such as a dry powder. One or more coats of boron nitride powder can be applied in varying thicknesses as the exposed surface on the interior surfaces of the bowl 150 and lid 140.

The thickness of the various layers of insulating material are not particularly limited, and can include any thickness that does not undesirably interfere with the delivery of the molten metal to the mold cavity, while still providing adequate insulation to inhibit gate stick. The various layers of insulating material can be fired either together after application of all or some of the layer, or can be fired individually before applying subsequent layers of insulating material. Various other insulating materials and layers can be applied individually, or in combination with other layers, to the interior surfaces 141, 151 of the lid 140 and bowl 150. Further, interior surfaces of the stalk 160 and the gate insert 120 can also be coated.

The insulation is not limited to a specific number or types of layers, but can include more or less layers, and layers that can include different types of materials.

The present subject matter includes methods for casting a cylinder head, or other objects, by promoting top-down directional solidification of molten metal in a mold. In one exemplary embodiment, a method of casting a cylinder head by directionally solidifying molten metal in a mold includes providing a mold defining a mold cavity 60. The mold includes at least one aperture 31 through which molten metal 2 is delivered to the mold cavity 60. As shown in FIGS. 1-3, the mold can include an upper mold 20, a lower mold 30, and side molds 40, 50 as previously described herein.

The method further includes providing a gate pin 100, which is insertable into the mold cavity 60. The gate pin 100, as previously described, defines an interior cooling passage 103, for circulating a cooling medium therein. The method includes positioning the gate pin 100 in the mold cavity 60, such that a distance 34 between the interior cooling passage 103 of the gate pin 100 and the aperture 31 is less than a width 32 of the aperture 31. This configuration is depicted in FIG. 4 wherein the gate pin 100 is positioned relative to the aperture 31 such that the distance 34 between the interior cooling passage 103 and the aperture 31 is less than a width 32 of the aperture 31.

As depicted in FIGS. 1-4, the gate pins 100 are positioned directly above each aperture 31 in the lower mold 30. However, it will be understood that the gate pins 100 do not have to be positioned directly above the apertures 31, but can be positioned elsewhere within the mold cavity 60 in order to promote top-down directional solidification of the molten metal. Further, the figures depict one gate pin 100 paired with each aperture in the lower mold 30. However, it will be understood that the present subject matter is not so limited, and can include an apparatus having a configuration wherein more than one gate pin 100 is associated with each aperture 31. For example, two or more gate pins can be associated with each aperture 31 in the lower mold 30.

The method further includes transporting molten metal through the aperture 31 and into the mold cavity 60 as previously described herein. This can be accomplished in many various ways, and in one embodiment includes utilizing a gating system 110 as depicted in FIGS. 1-4 and 7.

The method further includes directionally solidifying the molten metal in the mold cavity 60 from a top 61 of the mold cavity 60 to a bottom 62 of the mold cavity 60 (FIG. 3). Top-down directional solidification can be accomplished by circulating the cooling medium through the interior cooling passage 103 of the gate pins 100 to thereby form the cylinder head or other cast object 3. In accordance with one particular aspect of the method, the gate pin 100 is positioned in the mold cavity 60 such that a ratio of the distance 34 between the interior cooling passage 103 of the gate pin 100 and the aperture 31 to the width 32 of the aperture 31 is less than 0.5 to 1 in order to directionally solidifying the molten metal in the mold cavity 60 from a top 61 of the mold cavity 60 to a bottom 62 of the mold cavity 60. In another embodiment, top-down directional solidification can be accomplished with one or more of positioning the gate pin 100 in the mold cavity 60 such that a distance 34 between the interior cooling passage 103 of the gate pin 100 and the aperture 31 is less than a width 32 of the aperture 31; insulating the bowl 150 and lid 140; providing a gate 200 having a larger volume in the lower side 202 than in the upper side 201 of the gate 200; circulating the cooling medium through the gate pins 100 in a parallel fashion; and combinations thereof as described herein.

Further, the interior cooling passage 103 can extend between the first end 101 and the second end 102 of the gate pin 100 by a length 108 that is at least 90%, or at least 95%, of a length 107 of the gate pin 100. The interior cooling passage 103 can be open at the first end 101 and closed at the second end 102 of the gate pin 100, as previously described herein.

The method further includes providing a plurality of gate pins 100 inserted through the top of the mold and extending from the top 61 of the mold cavity 60 toward a bottom 62 of the mold cavity 60. A plurality of gate pins 100 is shown in FIGS. 1-3 and 7, wherein FIGS. 1 and 2 show four gate pins 100 which are each paired with an aperture 31 in the lower mold 30. In FIGS. 3 and 7, a portion of the casting apparatus 1 is depicted, specifically the left side 6 is shown, wherein two gate pins 100 are each paired with an aperture 31 in the lower mold 30.

The method also includes providing a cooling medium and circulating the cooling medium in a parallel fashion through the interior cooling passages 103 of each of the plurality of gate pins 100. Circulation of the cooling medium in a parallel fashion through each gate pin 100 ensures uniform cooling to the molten metal contained in the mold cavity 60 during a casting process and promotes top-down directional solidification. Circulation of the cooling medium in a parallel fashion can be accomplished by providing one or more cooling medium circulation channels 113 (FIGS. 1-3 and 7) that are configured to circulate the cooling medium in a parallel fashion through the interior cooling passages 103 of each of the plurality of gate pins 100.

The method additionally includes providing a gate insert 120 as previously described herein. The gate insert 120 can be configured, such that a ratio of a width 133 of the passage 123 at the second end 122 to a width 125 of the passage 123 at the first end 121 is greater than 1:1. Further, the gate insert 120 can be configured, such that the distance 127 between the first end 121 and the throat 124 promotes solidification of molten metal in the mold cavity 60 before solidification of molten metal in the gate insert 120. In one aspect, the gate insert 120 can be configured, such that a ratio of the length 132 of the passage 123 to the distance 134 between the second end 122 of the gate insert 120 and the throat 124 is less than about 3:1 as previously described.

The method includes connecting the first end 121 of the gate insert 120 to an exterior of the bottom of the mold, such that the passage 123 of the gate insert 120 is in fluid communication with the mold cavity 60 through the aperture. Connecting the first end 121 of the gate insert 120 to an exterior of the bottom of the mold can be accomplished by placing the gate insert 120 at least partially into the lower cavity 33 of the lower mold 30, as shown in FIGS. 1-4 and 7.

The method further includes transporting molten metal through the gate insert 120 into the mold cavity 60. In this way, molten metal can be delivered through the gate insert 120, through the aperture 31 of the lower mold 30, and into the mold cavity 60.

The methods can also include providing a bowl 150 and a lid 140, which were previously described herein. The methods can also include insulating the bowl 150 and/or the lid 140 on their respective inside surfaces 141, 151. The bowl 150 and the lid 140 are then connected to the gate insert 120 such that the bowl 150 and the lid 140 are in fluid communication with the mold cavity 60 through the gate insert 120, which is in fluid communication with the mold cavity 60 through the apertures 31 in the lower mold 30. Thereby, molten metal can be transported through the bowl 150, through the lid 140, through the gate insert 120, through the apertures 31 in the lower mold 30, and into the mold cavity 60. As previously described, the lid 140 includes bores 142 having a length 143 that partially define the gate 200, as shown in FIG. 4.

The method further includes transporting molten metal through the bowl 150 and the bores 140 of the lid 140. In this way, molten metal can be delivered through the bowl 150, through the bores 140 of the lid 140, through the gate insert 120, through the aperture 31 of the lower mold 30, and into the mold cavity 60. After transporting molten metal to the mold cavity 60, the molten metal is directionally solidified from the top-down by circulating cooling medium in the gate pins 100. Molten metal remaining in the gating system 110 is returned to the crucible 170 by reducing the pressure in the crucible 170. The mold is then opened and the cylinder head or other cast object 3, including the gate portion 7, is removed from the mold and can be free from the effects of gate stick.

Methods in accordance with the present description can employ the various strategies for inhibiting gate stick as described herein, either alone or in combination as desired. Such strategies can inhibit, or eliminate gate stick in casting processes used for making cylinder heads or other cast objects. Many other benefits will no doubt become apparent from future application and development of this technology.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A metal casting apparatus for casting a cylinder head, the casting apparatus comprising:

a mold defining a mold cavity and including an aperture through which molten metal is delivered to the mold cavity for casting the cylinder head, and a gate pin at least partially positioned in the mold cavity, the gate pin defining an interior cooling passage for circulating a cooling medium therein, wherein a distance between the aperture and the interior cooling passage of the gate pin is less than a width of the aperture.

2. The casting apparatus of claim 1, wherein a ratio of the distance between the aperture and the interior cooling passage to the lateral width of the aperture, is less than 0.5:1.

3. The casting apparatus of claim 1, wherein:

the gate pin comprises an elongated body including a first end and a second end, the second end facing the aperture, and the interior cooling passage extends at least 90% of a length between the first end and the second end of the gate pin, the interior cooling passage being open at the first end and closed at the second end of the gate pin.

4. The casting apparatus of claim 3, wherein the interior cooling passage extends at least 95% of a length of the gate pin.

5. The casting apparatus of claim 3, wherein the interior cooling passage extends to less than 10 millimeters (mm) from the second end of the gate pin.

6. The casting apparatus of claim 1, wherein the gate pin has a ratio of a width of the gate pin to a width of the interior cooling passage being from 5:1 to 1.5:1.

7. The casting apparatus of claim 1, further comprising:

a plurality of gate pins inserted through a top of the mold and extending from a top of the mold cavity toward a bottom of the mold cavity, and a cooling medium circulation channel configured so that the cooling medium circulates in parallel through the interior cooling passages of each of the plurality of gate pins.

8. The casting apparatus of claim 1, further comprising a gating system including a gate insert, the gate insert comprising a passage through which molten metal is delivered to the mold cavity, the passage extending through the gate insert from a first end of the gate insert to a second end of the gate insert, the passage comprising a constricted portion defining a throat, wherein the first end of the gate insert is facing the aperture such that the passage of the gate insert is in fluid communication with the mold cavity through the aperture.

9. The casting apparatus of claim 8, wherein:

the gating system further comprises a bowl and a lid including a bore, the bowl and the lid being in fluid communication with the mold cavity through the gate insert, and the aperture in the mold, the passage in the gate insert, and the bore in the lid together define a gate, and wherein a volume of the gate above the throat of the gate insert is less than a volume of the gate below the throat of the gate insert.

10. The casting apparatus of claim 9, wherein the bowl and the lid are insulated on inside surfaces.

11. The casting apparatus of claim 10, wherein the bowl and the lid are insulated with layers including a base layer comprising permanent mold coating, a first intermediate layer comprising ceramic fiber and permanent mold coating, a second intermediate layer comprising permanent mold coating, and a top layer comprising boron nitride powder.

12. The casting apparatus of claim 8, wherein a ratio of a width of the passage at the second end of the gate insert to a width of the passage at the first end of the gate insert is greater than 1:1.

13. The casting apparatus of claim 8, wherein a ratio of a length of the passage between the first end and the second end of the gate insert to a distance between the second end and the throat of the gate insert is less than about 3:1.

* * * * *